United States Patent [19]

Inoue et al.

[11] Patent Number: 4,824,774

[45] Date of Patent: Apr. 25, 1989

[54] SILVER HALIDE PHOTOGRAPHIC MATERIAL AND METHOD FOR FORMING AN ULTRAHIGH CONTRAST NEGATIVE IMAGE THEREWITH

[75] Inventors: Nobuaki Inoue; Senzo Sasaoka, both of Kanagawa, Japan

[73] Assignee: Fuji Photo Film Co., Ltd., Kanagawa, Japan

[21] Appl. No.: 95,738

[22] Filed: Sep. 14, 1987

Related U.S. Application Data

[63] Continuation-in-part of Ser. No. 845,298, Mar. 28, 1986, abandoned.

[30] Foreign Application Priority Data

Mar. 29, 1985 [JP] Japan ..... 60-66179

[51] Int. Cl.[4] ..... G03C 5/04; G03C 5/24; G03C 1/02

[52] U.S. Cl. ..... 430/566; 430/264; 430/486; 430/494; 430/640; 430/949

[58] Field of Search ..... 430/264, 486, 566, 494, 430/949, 640

[56] References Cited

U.S. PATENT DOCUMENTS

| | | | |
|---|---|---|---|
| 4,168,977 | 9/1979 | Takada et al. | 430/448 X |
| 4,224,401 | 9/1980 | Takada et al. | 430/567 |
| 4,243,739 | 1/1981 | Mifune et al. | 430/600 X |
| 4,269,929 | 5/1981 | Nothangle | 430/438 X |
| 4,272,606 | 6/1981 | Mifune et al. | 430/660 X |
| 4,311,781 | 1/1982 | Mifune et al. | 430/440 X |
| 4,510,228 | 4/1985 | Tsubai et al. | 430/642 |
| 4,560,638 | 12/1985 | Loblaw et al. | 430/264 |

OTHER PUBLICATIONS

T. H. James, "Coating Effects and Halogen Acceptance", Theory of the Photographic Process, (1977).

Research Disclosure No. 235 "Development Nucleation by Hydrazine and Hydrazine Derivatives", pp. 346–352, (1983).

*Primary Examiner*—Mukund J. Shah

*Attorney, Agent, or Firm*—Sughrue, Mion, Zinn, Macpeak, and Seas

[57] ABSTRACT

A silver halide negative photographic material is described, comprising a support, at least one silver halide emulsion layer, and one or more light-insensitive hydrophilic colloid layers, wherein said silver halide emulsion layer or said light-insensitive hydrophilic colloid layer contains a hydrazine derivative, and the photographic material has a film surface pH not higher than 5.8 on the side of said emulsion layer inclusive of said light-insensitive hydrophilic colloid layer; in another aspect, this invention is directed to a method for forming an ultrahigh contrast negative image, comprising exposing said photographic material imagewise, followed by development processing of the same with a developer containing at least 0.15 mol/liter of sulfite ion and having a pH of from 10.5 to 12.3.

20 Claims, No Drawings

SILVER HALIDE PHOTOGRAPHIC MATERIAL AND METHOD FOR FORMING AN ULTRAHIGH CONTRAST NEGATIVE IMAGE THEREWITH

This is a continuation-in-part of application Ser. No. 845,298, filed Mar. 28, 1986, now abandoned.

FIELD OF THE INVENTION

This invention relates to a silver halide photographic material and a method for forming an ultrahigh contrast negative image therewith, and more particularly to a silver halide photographic material for manufacturing a photographic printing plate and a method for forming an ultrahigh contrast negative image therewith.

BACKGROUND OF THE INVENTION

In the field of graphic arts, an image forming system that shows ultrahigh contrast photographic characteristics (especially with a gamma value of 10 or more) is necessary for improved reproduction of continuous dot image gradation or reproduction of a line image.

For this purpose, a special developer called a "lith developer" has heretofore been employed. This lith (lithographic) developer contains only a hydroquinone compound as the developing agent and a sulfite as the preservative. However, in order to prevent inhibition of the infectious developability of the hydroquinone compound, the sulfite has been used in the form of a formaldehyde adduct so as to keep the free sulfite ion concentration as low as possible (usually 0.1 mol/liter or less). As a consequence, the lith developer has a serious drawback in that it undergoes aerial oxidation so rapidly that its storage life is as short as three days.

For achieving a high contrast photographic characteristic with a stable developer, the use of various hydrazine derivatives has been proposed. Such hydrazine derivatives have been described in U.S. Pat. Nos. 4,224,401, 4,168,977, 4,166,742, 4,311,781, 4,272,606, 4,211,857, 4,243,739 and so on. By means of the use of such hydrazine compounds, satisfactory photographic characteristics such as ultrahigh contrast and high sensitivity may be obtained, and also the sulfite may be used in a higher concentration so that the stability of the developer against aerial oxidation may be increased over the conventional lith developer. However, such an image forming system is disadvantageous in that it gives rise to black spots which provide a serious problem to the photographic printing plate making process. These black spots, also known as black peppers, are tiny black specks appeared in the area between dots that is not intended to be developed and tend to increase and grow on aging of the photographic material and particularly during storage thereof under high temperature, high humidity conditions, or as the concentration of the sulfite ion used commonly as a preservative in the developer decreases or as the pH value of the solution increases. The formation of black peppers detracts considerably from the marketability of the product as a photographic material for manufacturing a photographic printing plate. Many efforts have been made to overcome this black pepper problem but improvement in black pepper is often accompanied by decreases in sensitivity and gamma, and there has been a strong demand for a photographic system conducive to an improvement in black pepper which does not entail losses of sensitivity and high contrast.

SUMMARY OF THE INVENTION

An object of this invention is to provide a silver halide photographic material having as photographic characteristics a gamma value of 10 or more, high sensitivity, ultrahigh contrast, and a minimum of black pepper, and a method for forming a negative image therewith.

The above mentioned object is accomplished by a silver halide negative photographic material comprising a support and at least one silver halide emulsion layer and one or more light-insensitive hydrophilic colloid layers, wherein said silver halide emulsion layer or said light-insensitive hydrophilic colloid layer contains a hydrazine compound, and a film surface pH of the photographic material on the side of said emulsion layer inclusive of said light-insensitive hydrophilic colloid layer is not higher than 5.8.

This invention is also directed to a method for producing an ultrahigh contrast negative image comprising imagewise exposing said photographic material followed by development processing of the same with a developer containing at least 0.15 mol/liter of sulfite ion and having a pH of from 10.5 to 12.3.

It is quite unexpected that the formation of black peppers can be prevented by the method of this invention in which a film surface pH on the side of the emulsion layer is adjusted to not higher than 5.8.

DETAILED DESCRIPTION OF THE INVENTION

The hydrazine compound used in accordance with this invention includes the sulfinyl-containing hydrazine derivatives described in U.S. Pat. No. 4,478,928 and compounds represented by formula (I)

$$R_1\text{—NHNH—CHO} \qquad \text{(I)}$$

wherein $R_1$ represents an aliphatic group or an aromatic group.

Referring to formula (I), the aliphatic group represented by $R_1$ is preferably a group containing from 1 to 30 carbon atoms and, for still better results, a straight chain, branched, or cyclic alkyl group containing from 1 to 20 carbon atoms. The branched alkyl group may be cyclized to form a saturated heterocyclic ring including 1 or more hetero atoms. Moreover, this alkyl group may have such substituents as an aryl group, an alkoxyl group, a sulfoxy group, a sulfonamido group, a carbonamido group, etc. Thus, for example, a t-butyl group, an n-octyl group, a t-octyl group, a cyclohexyl group, a pyrrolidyl group, an imidazolyl group, a tetrahydrofuryl group and a morpholino group may be present as substituents.

Referring further to formula (I), the aromatic group represented by $R_1$ is a monocyclic or bicyclic aryl group or an unsaturated heterocyclic group. The unsaturated heterocyclic group mentioned just above may be condensed with a monocyclic or bicyclic aryl group to form a heteroaryl group. Thus, for example, groups containing a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring or the like may be mentioned, although groups containing a benzene ring are preferred.

Particularly preferred examples of $R_1$ are aryl groups.

The aryl group or aromatic group represented by $R_1$ may have substituents.

Representative examples of such substituents are straight chain, branched or cyclic alkyl groups (preferably of from 1 to 20 carbon atoms), aralkyl groups (preferably monocyclic or bicyclic groups whose alkyl moieties contain from 1 to 3 carbon atoms), alkoxyl groups (preferably those containing from 1 to 20 carbon atoms), substituted amino groups (preferably substituted with alkyl groups of from 1 to 20 carbon atoms), acylamino groups (preferably of from 2 to 30 carbon atoms), sulfonamido groups (preferably containing from 1 to 30 carbon atoms) and ureido groups (preferably containing from 1 to 30 carbon atoms).

$R_1$ in formula (I) may contain a ballast group which is commonly used in immobile photographic additives such as a coupler. The ballast group is a group containing 8 or more carbon atoms which is comparatively photographically inert and can be selected from among, for example, alkyl, alkoxyl, phenyl, alkylphenyl, phenoxy and alkylphenoxy groups.

Referring further to formula (I), $R_1$ may contain a group providing a greater adsorption on the surface of the silver halide grain. Examples of such groups include thiourea groups, heterocyclic thioamide groups, mercapto heterocyclic groups, triazole groups and other groups, such as are described in U.S. Pat. No. 4,385,108.

Methods for synthesizing such hydrazine compounds are well described in the technical literature, including Japanese Patent Application (OPI) Nos. 20921/78, 20922/78, 66732/78 and 20318/78 (the term "OPI" as used herein refers to a "published unexamined Japanese patent application").

In adding the hydrazine compound to the photographic material in accordance with this invention, the hydrazine compound is preferably incorporated in the silver halide emulsion layer, although it may be added to any other light-insensitive hydrophilic colloid layer (for example, the protective layer, intermediate layer, filter layer, antihalation layer, etc.). More specifically, when the hydrazine compound to be used is water-soluble, it may be added in the form of aqueous solution, and when it is slightly soluble in water, it may be dissolved in a water-miscible organic solvent such as alcohols, ester, ketones, etc., and the solution is added to the hydrophilic colloid solution. When the hydrazine compound is added to the silver halide emulsion layer, it may be added at any time after the start of chemical ripening until the stage immediately prior to coating, but is preferably added during the interval between completion of chemical ripening nd the start of coating.

With regard to the amount of the hydrazine compound, the optimum amount is preferably selected and used according to the grain size of the silver halide emulsion, halogen composition thereof, method and degree of chemical ripening, the relation between the layer in which the hydrazine compound is incior-porated and the silver halide emulsion layer, the type of antifoggant used, etc. Procedures for selection of such optimum amount are well known to those skilled in the art. In general, the hydrazine compound is used in an amount of from $10^{-6}$ to $1\times10^{-1}$ mol, and preferably from $10^{-5}$ to $4\times10^{-2}$ mol, per mol of silver halide.

The following are examples of the compounds represented by formula (I). It is to be understood that this invention is by no means limited to these particular compounds.

I-1

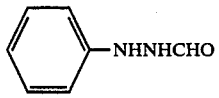

I-2

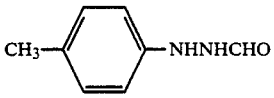

I-3

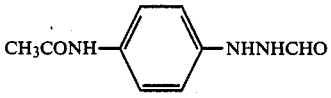

I-4

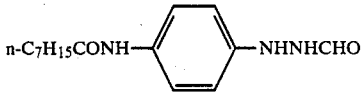

I-5

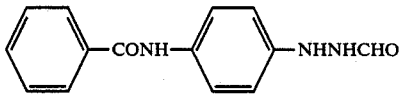

I-6

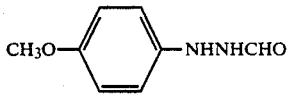

I-7

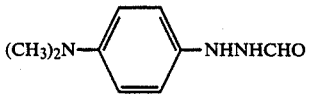

I-8

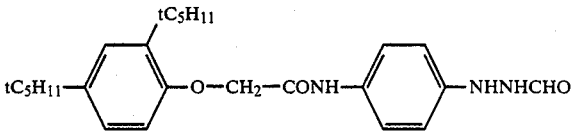

I-9

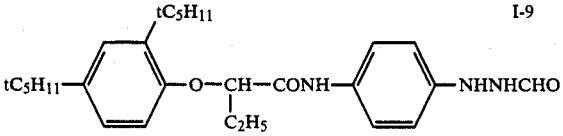

I-10

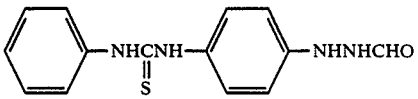

I-11

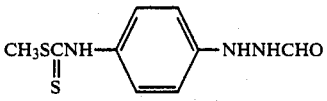

I-12

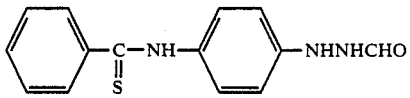

-continued
I-13
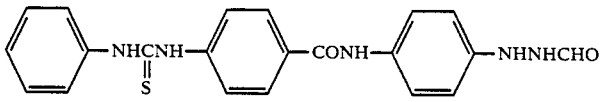
I-14
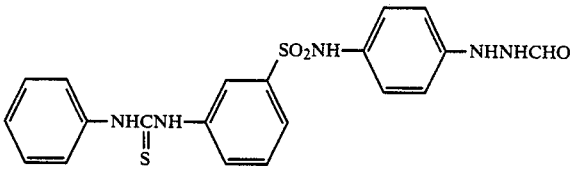
I-15
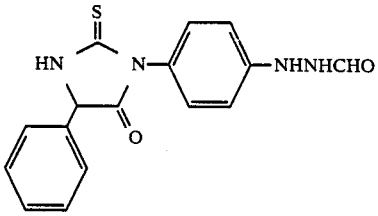
I-16
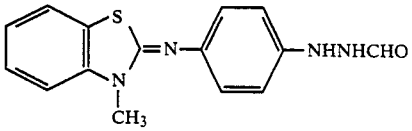
I-17
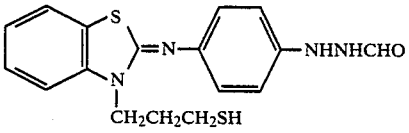
I-18
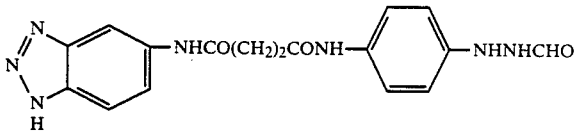
I-19
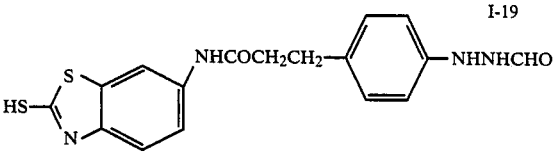
I-20
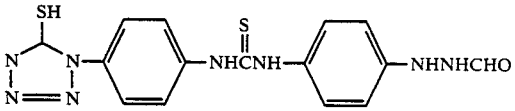
I-21
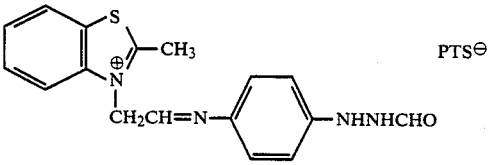
I-22
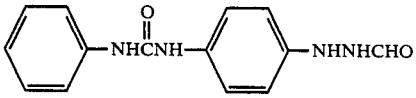
PTS⊖ indicates a p-toluene sulfonate ion.
I-23
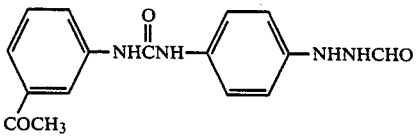
I-24
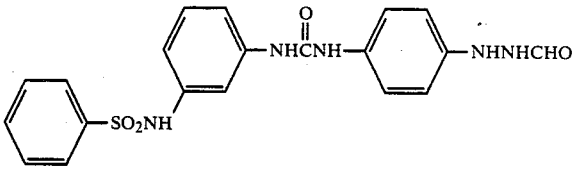
I-25
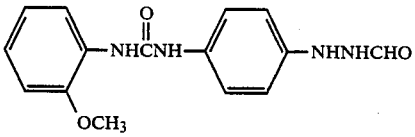
I-26
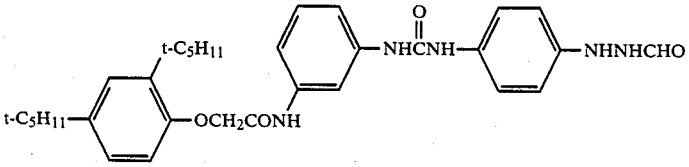

-continued

I-27

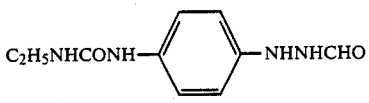

I-28

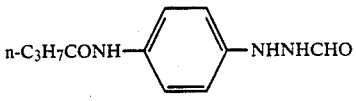

I-29

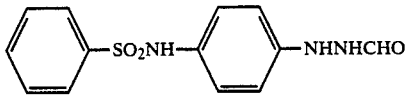

In addition to the above compounds, the following compounds as described in U.S. Pat. No. 4,478,928 can also be employed.

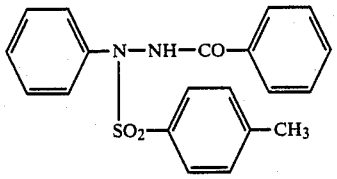

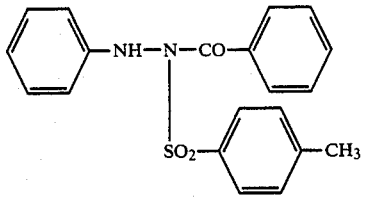

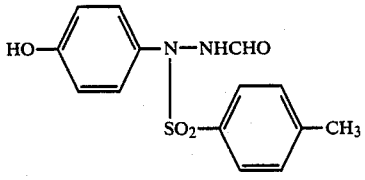

In this invention, the film surface of the photographic material on the side of the emulsion layer is adjusted to a pH of 5.8 or less, and for this purpose an acid is preferably used.

The acid used for adjusting the surface pH value may be an organic acid or an inorganic acid. As an alternative, a salt of a volatile base such as ammonium sulfate with a strong acid may be added to the coating dope. Preferred is the addition of an organic acid such as acetic acid, citric acid (inclusive of its esters), phthalic acid, salicylic acid, caproic acid, adipic acid, succinic acid, maleic acid, fumaric acid, benzoic acid, decanoic acid, ascorbic acid, cyclohexanecarboxylic acid, cinnamic acid, 3,4-dimethylbenzoic acid, β-naphthoic acid, phenylacetic acid, malonic acid, terephthalic acid, 2-ethylhexanoic acid, α-methylcinnamic acid, p-chlorobenzoic acid, mandelic acid, erythorbic acid, tartaric acid, 5-sulfosalicylic acid, etc. The acid may be added to any optional layer among the subbing layer, emulsion layer, protective layer and so on. As a further alternative, a solution containing such an acid may be coated on the photographic material after the usual coating procedure.

The terminology "film surface pH" as used in this specification means a pH value found by the following procedure. 0.05 cc of water is applied to a 1 $cm^2$ area on the surface of the photographic material and the photographic material is allowed to stand in an atmosphere of 90% relative humidity for 10 minutes. Then, the pH of its surface is measured by means of a glass plate electrode integrated with a silver chloride electrode (AgCl/KCl) as a reference electrode (flat composite electrode). An example of such flat composite electrode is the flat composite electrode GS-165F manufactured by Toa Electronics, Ltd.

The film surface pH in this invention should be a pH of not higher than 5.8 and preferably the pH is from 4.5 to 5.6.

The silver halide emulsion in this invention may comprise any of silver chloride, silver chlorobromide, silver iodobromide, silver iodochlorobromide, etc., but preferably contains at least 70 mol%, and for still better results at least 90 mol%, of silver bromide. The silver iodide content is preferably not more than 10 mol%, and more desirably is in the range of from 0.1 to 5 mol%.

In regard to the average grain size of silver halide used in accordance with this invention, fine grains (for example, 0.7 μm or less) are preferable, and very fine grains not larger than 0.5 μm are particularly preferable. While the grain size distribution is basically optional, a monodispersion is preferable. The term "monodispersion" as used herein means that, whether in weight or in number, at least 95% of grains are sized within ±40% of the mean grain size.

The silver halide grains in the photographic emulsion may be regular crystals such as cubes or octahedrons, or irregular crystals such as spheres or plates. They may be of composites of such diverse crystal shapes also.

Each of the silver halide grains may be made up of a uniform phase throughout its core and surface layer, or may be dissimilar in phase between the core and the surface. It is also possible to use two or more independently prepared silver halide emulsions as a mixture.

In the course of formation of silver halide grains or in the process of physical ripening, there may be added to the silver halide emulsion of this invention a cadmium salt, sulfite, lead salt, thallium salt, rhodium salt or rhodium complex salt, iridium salt or iridium complex salt, or the like.

A silver halide particularly suitable for the purposes of this invention is prepared in the presence of from $10^{-8}$ to $10^{-5}$ mol of an iridium salt or an iridium complex salt per mol of silver and is a silver haloiodide whose silver iodide content in the surface layer of the grain is larger than the mean silver iodide content of the grain. The use of such a silver haloiodide-containing emulsion results in still better photographic characteristics having improved sensitivity and higher gamma.

In this connection, the above mentioned amount of iridium salt is preferably added before completion of physical ripening in the production process of the silver halide emulsion, particularly at the formation of grains.

The iridium salt used for the above purpose is a water-soluble iridium salt or iridium complex salt, such as iridium trichloride, iridium tetrachloride, potassium hexachloroiridate (III), potassium hexachloroiridate (IV), ammonium hexachloroiridate (III), etc.

As the binder or protective colloid for the photographic emulsion, gelatin is advantageously used but other hydrophilic colloids can also be employed. For example, gelatin derivatives, graft copolymers of gelatin to other high polymers, proteins such as albumin and casein, cellulose derivatives such as hydroxyethyl cellulose, carboxymethyl cellulose, cellulose sulfate esters, etc., sugar derivatives such as sodium alginate, starch derivatives, etc., and synthetic homo- or copolymers such as polyvinyl alcohol, partially acetalized polyvinyl alcohol, poly-N-vinylpyrrolidone, polyacrylic acid, polymethacrylic acid, polyacrylamide, polyvinylimidazole, polyvinylpyrazole, and so on.

The silver halide emulsion employed in accordance with this invention may be chemically sensitized. Known methods for chemical sensitization of silver halide emulsions include sulfur sensitization, reduction sensitization and noble metal sensitization, and the chemical sensitization may be effected by any or a combination of such methods.

The most representative of the noble metal sensitization is gold sensitization, and for this purpose, a gold compound, mainly a complex salt of gold, is utilized. Complex salts of other noble metals such as platinum, palladium, rhodium, etc., may be additionally contained. Examples of this method are described in U.S. Pat. No. 2,448,060 and British Pat. No. 618,061.

Sulfur sensitizers include, in addition to sulfur compounds contained in gelatin, various sulfur compounds such as thiosulfates, thiourea compounds, thiazoles, rhodanines, and the like.

Reduction sensitizers include stannous salts, amines, formamidinesulfinic acid, silane compounds and the like.

For the purpose of increasing the sensitivity of the photographic material of this invention, sensitizing dyes described in Japanese Patent Application (OPI) No. 52050/80 at pages 45 to 53 (for example, cyanine dyes, merocyanine dyes, etc.) can be added to the photographic material.

While these sensitizing dyes may be used alone, they can also be used in combination and such a combination of dissimilar sensitizing dyes are often utilized for supersensitization. Besides these sensitizing dyes, dyes which do not have their own spectral sensitizing function or substances which do not substantially absorb visible light but supersensitize the sensitizing dyes may also be included in the emulsion.

Useful sensitizing dyes, combinations of dyes which show supersensitization, and supersensitizing additives are mentioned in *Research Disclosure,* RD No. 17643 (December, 1978), page 23, IV-J.

In the photographic material of this invention, there may be incorporated a variety of compounds for the prevention of fog during production, storage or photographic processing or for the purpose of stabilizing its photographic qualities. Thus, for example, there may be added the compounds referred to commonly as antifoggants or stabilizers, for example, various azole compounds such as benzothiazolium salts, nitroimidazoles, chlorobenzimidazoles, bromobenzimidazoles, mercaptothiazoles, mercaptobenzothiazoles, mercaptothiadiazoles, aminotriazoles, benzothiazoles, nitrobenzothiazoles, etc.; mercaptopyrimidines, thioketo compounds such as oxazolylthione, etc.; azaindenes such as triazaindenes, tetraazaindenes (particularly, 4-hydroxy-substituted(1,3,3a,7)tetraazaindenes), pentaazaindenes, etc.; benzenethiosulfonic acid, benzenesulfinic acid, benzenesulfonamide, etc. Among these compounds, benzotriazoles (e.g., 5-methylbenzotriazole) and nitroindazoles (e.g., 5-nitroindazole) are preferred. These compounds may be incorporated in the processing solution.

The photographic material of this invention may contain inorganic or organic hardening agents in its photographic emulsion layer or other hydrophilic colloid layer. For this purpose, chromium salts (chrome alum, chromium acetate, etc.), aldehydes (formaldehyde, glyoxal, glutaraldehyde, etc.), N-methylol compounds (dimethylolurea, methyloldimethylhydantoin, etc.), dioxane derivatives (2,3-dihydroxydioxane, etc.), active vinyl compounds (1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.A), and the like. These hardening agents may be incorporated alone or in combination.

In the photographic emulsion layer or other hydrophilic colloid layer in the photographic material produced in accordance with this invention, a variety of surface active agents may be incorporated for various purposes, such as improvement of coating properties, antistatic properties, slipping properties, emulsion dispersibility, anti-adhesion properties, and photographic properties (for example, development acceleration, increase in contrast, sensitization, etc.).

For example, nonionic surfactants such as saponin (steroidal), alkylene oxide derivatives (e.g., polyethylene glycol, polyethylene glycol/polypropylene glycol condensate, polyethylene glycol alkyl ethers, polyethylene glycol alkyl aryl ethers, polyethylene glycol esters, polyethylene glycol sorbitan esters, polyalkylene glycol alkylamines or amides, silicone-polyethylene oxide adducts), glycidol derivatives (e.g., alkenylsuccinic acid polyglyceride, alkylphenol polyglyceride), polyhydric alcohol-fatty acid esters, sugar alkyl esters, etc.; anionic surfactants containing acidic groups such as a carboxyl group, a sulfo group, a phospho group, a sulfuric acid ester group, a phosphoric acid ester group, etc., for example, alkylcarboxylates, alkylsulfonates, alkylbenzenesulfonates, alkylnaphthalenesulfonates, alkylsulfuric acid esters, alkylphosphoric acid esters, N-acyl-N-alkyltaurines, sulfosuccinic acid esters, sulfoalkylpolyoxyethylene alkylphenyl ethers, polyoxyethylene alkylphosphoric acid esters, etc.; amphoteric surfactants such as amino acids, aminoalkylsulfonic acids, aminoalkylsulfuric or phosphoric acid esters, alkylbetaines, amine oxides, etc.; and cationic surfactants such as alkylamines, aliphatic or aromatic quaternary ammonium salts, heterocyclic quaternary ammonium salts such as pyridinium salts, imidazolium salts, etc., aliphatic or heterocyclic ring-containing phosphonium or sulfonium salts, etc.

The surfactants which are preferably used in this invention are polyalkylene oxides having a molecular weight of 600 or more such as described in Japanese Patent Publication No. 9412/83.

In the photographic emulsion layer or other hydrophilic colloid layer of the photographic material according to this invention, matting agents such as silica, magnesium oxide, polymethyl methacrylate, etc., may be incorporated for the purpose of preventing adhesion.

For the purpose of improving the dimensional stability of the photographic material according to this invention, a dispersion of a synthetic polymer, whether it is water-soluble or slightly water-soluble, can be incorporated. Examples of the synthetic polymer include polymers consisting of one or more monomers such as alkyl(meth)acrylates, alkoxyalkyl(meth)acrylates, glycidyl(meth)acrylate, (meth)acrylamide, vinyl esters (e.g., vinyl acetate), acrylonitrile, olefins, styrene, etc., or polymers consisting of the above mentioned monomers and one or more of such other monomers as acrylic acid, methacrylic acid, $\alpha,\beta$-unsaturated dicarboxylic acids, hydroxyalkyl(meth)acrylates, sulfoalkyl(meth)acrylates, styrenesulfonic acid, etc. Thus, for example, the polymers described in U.S. Pat. Nos. 2,376,005, 2,739,137, 2,853,457, 3,062,674, 3,411,911, 3,525,620, 3,607,290 and 3,645,740 can be employed.

The support of the photographic material according to this invention may be made of cellulose triacetate, cellulose diacetate, nitrocellulose, polystyrene, polyethylene terephthalate or the like. However, the use of polyethylene terephthalate is particularly useful for achieving the superior effect of this invention.

In order to obtain ultrahigh contrast, high sensitivity photographic characteristics using the silver halide photographic material according to this invention, it is not necessary to employ either the usual infectious developer or a developer with high alkalinity close to pH 13 such as the one described in U.S. Pat. No. 2,419,975. Rather a more stable developer can be employed in this invention.

Thus, the silver halide photographic material according to this invention provides a sufficient ultrahigh contrast negative image using a developer containing at least 0.15 mol/liter of sulfite ion as a preservative, and having a pH value in the range of from 10.5 to 12.3 and particularly preferably in the range of from 11.0 to 12.3.

There is no particular limitation on the developing agents that can be employed in the method of this invention. Thus, for example, dihydroxybenzenes (e.g., hydroquinone), 3-pyrazolidones (e.g., 1-phenyl-3-pyrazolidone, 4,4-dimethyl-1-phenyl-3-pyrazolidone), aminophenols (e.g., N-methyl-p-aminoiphenol), etc., can be used alone or in combination.

The silver halide photographic material according to this invention is especially suitable for processing with a developer containing a dihydroxybenzene compound as the developing agent and a 3-pyrazolidone compound or an aminophenol compound as the auxiliary developing agent. The preferred concentrations of these compounds in the developer are from 0.05 to 0.5 mol/liter for the dihydroxybenzene, and 0.06 mol/liter or less for 3-pyrazolidone or aminophenol.

As described in U.S. Pat. No. 4,269,929, amine compounds may be added to the developer to thereby increase the rate of development, and, hence, realize a reduction in development time.

In addition to the foregoing compounds, there may be added to the developer other additives including pH buffers such as sulfites, carbonates, borates, and phosphates of alkali metals, development restrainers or antifoggants such as bromides, iodides and organic anti-foggants (preferably nitroindazoles and benzotriazoles). If desired, water softeners, solubilizing agents or cosolvents, toners, development accelerators, surfactants (preferably aforesaid polyalkylene oxides), antifoams, hardeners, and silver stain inhibitors (e.g., 2-mercaptobenzimidazolesulfonic acids) may also be incorporated in the developer.

As a fixing bath, a solution of the conventional composition may be employed. Thiosulfates, thiocyanates, and those organic sulfur compounds which are generally known to be effective fixing agents can be used as fixing agents in the bath. The fixing bath may contain a water-soluble salt of aluminum or the like as a hardener.

In the method of this invention, the processing temperature is generally selected within the range of from 18° C. to 50° C.

For photographic processing, an automatic developing machine is desirably used, and a sufficient ultrahigh contrast negative image can be obtained even with a processing time, i.e., the time from entry of the photographic material into the machine to exit from the machine, of from 90 to 120 seconds.

The photographic material according to this invention contains a hydrazine derivative, those of formula (I), and has a film surface pH of 5.8 or less as defined in this specification. As such, this photographic material yields high sensitivity, ultrahigh contrast characteristics with a minimum of black pepper which are of value for reproduction of dot and line images.

This invention is illustrated in more detail with reference to the following examples. However, the examples are not to be construed as being limited thereto.

In these examples, a developer of the following basic formulation was used.

| Basic Developer Formulation | |
|---|---|
| Hydroquinone | 35.0 g |
| N—Methyl-p-aminophenol.½Sulfate | 0.8 g |
| Sodium Hydroxide | 13.0 g |
| Potassium Tertiary Phosphate | 74.0 g |
| Potassium Sulfite | 90.0 g |
| Tetrasodium Ethylenediaminetetraacetate | 1.0 g |
| Potassium Bromide | 4.0 g |
| 5-Methylbenzotriazole | 0.6 g |
| 3-Diethylamino-1,2-propanediol | 15.0 g |
| Water to make | 1 liter |
| | (pH = 11.5) |

The above developer composition adjusted to pH 11.5 is referred to as Developer (I), and the same developer composition adjusted to pH 11.6 is referred to as Developer (II).

EXAMPLE 1

To an aqueous solution of gelatin held at 50° C., an aqueous solution of silver nitrate, an aqueous solution of potassium iodide and an aqueous solution of potassium bromide were simultaneously added over a period of 60 minutes in the presence of $4\times10^{-7}$ mol of iridium(III) hexachloride per mol of Ag and ammonia with pAg being maintained at 7.8 throughout the period. The above procedure provided a cubic grain monodispersion type emulsion with a mean grain diameter of 0.25 μm and a mean silver iodide content of 1 mol%. To portions of the above silver bromide emulsion, there were added 5,5'-dichloro-9-ethyl-3,3'-bis(3-sulfopropyl-)oxacarbocyanine sodium as the sensitizing dye, 4-hydroxy-6-methyl-1,3,3a,7-tetraazaindene as the stabilizer, polyethyl acrylate dispersion, polyethylene glycol, 1,3-vinylsulfonyl-2-propanol, and Compound I-9, and after pH adjustment with citric acid, each composition was coated on a polyethylene terephthalate film with a silver coverage of 3.4 g/m². Gelatin was coated in superimposition on the thus formed emulsion layer to give a gelatin coverage of 1.0 g/m². Each of these samples was exposed and developed and its photographic characteristics were measured. The results are shown in Table 1. The film surface pH was measured by the procedure set forth above. It is apparent from Table 1 that Samples 4 to 9 according to this invention are superior to Comparative Samples 1 to 3 in terms of black pepper inhibition.

TABLE 1

| Sample No. | Amount Added of Compound I-9 (mol/mol Ag) | Film Surface pH | Developer | Photographic Characteristics: Relative Sensitivity | Photographic Characteristics: Gamma | Black Pepper Evaluation |
|---|---|---|---|---|---|---|
| 1 | $3 \times 10^{-3}$ | 6.5 | I | 100 | 16 | 1 |
| 2 | " | 6.2 | I | 100 | 16 | 1.5 |
| 3 | " | 5.9 | I | 98 | 15.5 | 2.5 |
| 4 | " | 5.7 | I | 95 | 14 | 5 |
| 5 | " | 5.7 | II | 102 | 16.5 | 4.5 |
| 6 | $3.3 \times 10^{-3}$ | 5.7 | I | 100 | 16 | 4.5 |
| 7 | " | 5.7 | II | 107 | 16.5 | 4 |
| 8 | " | 5.5 | I | 98 | 16 | 4.5 |
| 9 | " | 5.5 | II | 107 | 17 | 4 |
| 10 | $3.6 \times 10^{-3}$ | 5.0 | II | 102 | 17.5 | 4 |

Note:
(1) The relative sensitivity is a relative value of the reciprocal of the amount of exposure giving a density of 1.5 in 30 second development at 38° C., as calculated with the corresponding value of Sample 1 taken as 100.
(2) The black pepper evaluation is the result of microscopic observation as evaluated on a 5-point scale: "5" represents the highest quality and "1" the lowest quality. Scores of "4" or higher indicate that the product has valuable commercial quality, "3" indicates that the product is of poor quality but is marginally usable, and "2" or less indicates that the product is not usable.
(3) The black pepper evaluation is based on a determination made after development with Developer II at 38° C. for 40 seconds.

EXAMPLE 2

In the same manner as Example 1, a silver bromide emulsion was prepared and then samples were prepared except that Compound I-25 was used in place of Compound I-9. These samples were exposed and developed and their photographic characteristics were evaluated. The results are shown in Table 2. It is apparent that Invention Samples 14 to 17 are superior to Comparative Samples 10 to 13.

TABLE 2

| Sample No. | Amount Added of Compound I-25 (mol/mol Ag) | Film Surface pH | Developer | Photographic Characteristics: Relative Sensitivity | Photographic Characteristics: Gamma | Black Pepper Evaluation |
|---|---|---|---|---|---|---|
| 10 | $2 \times 10^{-4}$ | 6.5 | I | 100 | 17 | 2 |
| 11 | $4 \times 10^{-4}$ | 6.5 | I | 110 | 18 | 1 |
| 12 | $3 \times 10^{-4}$ | 6.0 | I | 102 | 17 | 2 |
| 13 | $5 \times 10^{-4}$ | 6.0 | I | 112 | 18 | 2 |
| 14 | $3 \times 10^{-4}$ | 5.8 | I | 102 | 16.5 | 4 |
| 15 | $5 \times 10^{-4}$ | 5.8 | I | 110 | 18 | 3.5 |
| 16 | $4 \times 10^{-4}$ | 5.0 | I | 98 | 16.0 | 5 |
| 17 | $6 \times 10^{-4}$ | 5.0 | I | 107 | 18 | 4 |

Note:
(1) The relative sensitivity and black pepper were evaluated as described in Example 1.
(2) The black pepper evaluation is the result after development with Developer II at 38° C. for 40 seconds.

While the invention has been described in detail and with reference to specific embodiments thereof, it will be apparent to one skilled in the art that various changes and modifications can be made therein without departing from the spirit and scope thereof.

What is claimed is:

1. A silver halide negative photographic material comprising a support, at least one silver halide emulsion layer, and one or more light-insensitive hydrophilic colloid layers, wherein said silver halide emulsion layer or said light-insensitive hydrophilic colloid layer contains a hydrazine derivative, and the photographic material has a film surface pH not higher than 5.8 on the side of said emulsion layer inclusive of said light-insensitive hydrophilic colloid layer, wherein film surface pH is maintained at not higher than 5.8 using an organic acid or an ester of citric acid.

2. A silver halide negative photographic material as in claim 1, wherein the hydrazine derivative is represented by formula (I)

$$R_1\text{—NHNH—CHO} \qquad \text{(I)}$$

wherein $R_1$ represents an aliphatic group or an aromatic group.

3. A silver halide negative photographic material as in claim 2, wherein $R_1$ in formula (I) represents a straight chain, branched or cyclic alkyl group containing from 1 to 20 carbon atoms.

4. A silver halide negative photographic material as in claim 2, wherein the alkyl group represented by $R_1$ is substituted with an aryl group, an alkoxyl group, a sulfoxy group, a sulfonamido group or a carbonamido group.

5. A silver halide negative photographic material as in claim 2, wherein the aromatic group represented by $R_1$ is a monocyclic aryl group, a bicyclic aryl group or an unsaturated heterocyclic group.

6. A silver halide negative photographic material as in claim 1, wherein the hydrazine derivative is contained in an amount of from $1 \times 10^{-6}$ to $1 \times 10^{-1}$ mol per mol of silver halide.

7. A silver halide negative photographic material as in claim 1, wherein the hydrazine derivative is contained in an amount of from $1\times10^{-5}$ to $4\times10^{-2}$ mol per mol of silver halide.

8. A silver halide negative photographic material as in claim 1, wherein the hydrazine derivative is incorporated in the silver halide emulsion layer.

9. A silver halide negative photographic material as in claim 1, wherein the photographic material has a film surface pH of from 4.5 to 5.6.

10. A silver halide negative photographic material as in claim 8, wherein the photographic material has a film surface pH of from 4.5 to 5.6.

11. A silver halide negative photographic materials as in claim 1, wherein the silver halide of the silver halide emulsion layer is prepared in the presence of from $10^{-8}$ to $10^{-5}$ mol of an iridium salt or an iridium complex salt per mol of silver and is a silver haloiodide whose silver iodide content in the surface layer of the grain is larger than the mean silver iodide content of the grain.

12. A method for forming an ultrahigh contrast negative image employing a negative silver halide photographic material comprising a support, at least one silver halide emulsion layer, and one or more light-insensitive hydrophilic colloid layers, wherein said silver halide emulsion layer or said light-insensitive hydrophilic colloid layer contains a hydrazine derivative, and the film surface pH of said photographic material on the side of said emulsion layer inclusive of said light-insensitive hydrophilic colloid layer is not higher than 5.8, said method comprising imagewise exposure, followed by development processing of the photographic material with a developer containing at least 0.15 mol/liter of sulfite ion and having pH of from 10.5 to 12.3, wherein film surface pH is maintained at not higher than 5.8 using an organic acid or an ester of citric acid.

13. A method for forming an ultrahigh contrast negative image as in claim 12, wherein the hydrazine derivative is contained in an amount of from $1\times10^{-6}$ to $1\times10^{-1}$ mol per mol of silver halide.

14. A method for forming an ultrahigh contrast negative image as in claim 12, wherein the hydrazine derivative is contained in an amount of from $1\times10^{-5}$ to $4\times10^{-2}$ mol per mol of silver halide.

15. A method for forming an ultrahigh contrast negative image as in claim 12, wherein the hydrazine derivative is incorporated in the silver halide emulsion layer.

16. A method for forming an ultrahigh contrast negative image as in claim 12, wherein the photographic material has a film surface pH of from 4.0 to 5.6.

17. A method for forming an ultrahigh contrast negative image as in claim 12, wherein the silver halide of the silver halide emulsion layer is prepared in the presence of from $10^{-8}$ to $10^{-5}$ mol of an iridium salt or an iridium complex salt per mol of silver and is a silver haloiodide whose silver iodide content in the surface layer of the grain is larger than the mean silver iodide content of the grain.

18. A method for forming an ultrahigh contrast negative image as in claim 12, wherein the developer has a pH of from 11.0 to 12.3.

19. The silver halide negative photographic material of claim 1, wherein the organic acid is selected from the group consisting of acetic acid, citric acid, an ester of citric acid, phthalic acid, salicylic acid, caproic acid, adipic acid, succinic acid, maleic acid, fumaric acid, benzoic acid, decanoic acid, ascorbic acid, cyclohexanecarboxylic acid, cinnamic acid, 3,4-dimethylbenzoic acid, β-naphthoic acid, phenylacetic acid, malonic acid, terephthalic acid, 2-ethylhexanoic acid, α-methylcinnamic acid, p-chlorobenzoic acid, mandelic acid, erythorbic acid, tartaric acid and 5-sulfosalicylic acid.

20. The method of claim 12, wherein said organic acid is selected from the group consisting of acetic acid, citric acid, an ester of citric acid, phthalic acid, salicylic acid, caproic acid, adipic acid, succinic acid, maleic acid, fumaric acid, benzoic acid, decanoic acid, ascorbic acid, cyclohexanecarboxylic acid, cinnamic acid, 3,4-dimethylbenzoic acid, β-naphthoic acid, phenylacetic acid, malonic acid, terephthalic acid, 2-ethylhexanoic acid, α-methylcinnamic acid, p-chlorobenzoic acid, mandelic acid, erythorbic acid, tartaric acid and 5-sulfosalicyclic acid.

* * * * *